United States Patent [19]

Ramirez

[11] Patent Number: 5,050,574

[45] Date of Patent: Sep. 24, 1991

[54] BASEBALL PITCHING MACHINE

[76] Inventor: Aubrey Ramirez, 728 Ridge Dr., Sand Springs, Okla. 74063

[21] Appl. No.: 533,528

[22] Filed: Jun. 5, 1990

[51] Int. Cl.[5] ..... B41B 6/00

[52] U.S. Cl. ..... 124/3; 89/6; 273/26 D

[58] Field of Search ..... 124/3, 17, 21; 273/26 R, 26 D; 89/6

[56] References Cited

U.S. PATENT DOCUMENTS

| | | | |
|---|---|---|---|
| 1,190,565 | 7/1916 | Long | 273/26 D |
| 1,543,144 | 6/1925 | Wurm | 124/21 |
| 1,565,895 | 12/1925 | Blaustein . | |
| 1,985,254 | 12/1934 | Huse | 124/3 X |
| 2,390,247 | 12/1945 | Ford . | |
| 2,746,206 | 5/1956 | Hammond, Jr. | 124/3 X |
| 3,091,462 | 5/1963 | Harberts | 124/17 X |
| 3,408,768 | 11/1968 | Glass et al. | 124/21 X |
| 4,579,340 | 4/1986 | Jenkins et al. | 124/3 X |
| 4,765,222 | 8/1988 | Pinson . | |

FOREIGN PATENT DOCUMENTS

| | | | |
|---|---|---|---|
| 3407972 | 10/1985 | Fed. Rep. of Germany | 273/26 D |
| 0022203 | 12/1920 | France | 124/21 |
| 1023098 | 1/1989 | Japan | 124/3 |

*Primary Examiner*—Peter M. Cuomo
*Assistant Examiner*—Carol I. Bordas
*Attorney, Agent, or Firm*—Terry M. Gernstein

[57] ABSTRACT

A baseball pitching machine including a metal cart that rides on a plastic elliptical track wherein the metal cart carries a baseball and is controlled by a series of switches that command a rectangular-shaped electromagnet mounted on the plastic track and having an opening. The electromagnet is turned on via a switch and the metal car accelerates toward the electromagnet till it engages a projection mounted on the track which turns off the electromagnet. The momentum gained by the cart then carries the cart to a curve of the elliptical track where the baseball is projected as the cart goes around the curve of the track. After the cart protects the ball the metal cart proceeds along the track to the starting point where the cart is ready to reload with another baseball and the operation starts over with the switching on of the electromagnet.

5 Claims, 3 Drawing Sheets

BASEBALL PITCHING MACHINE

TECHNICAL FIELD OF THE INVENTION

The present invention relates to the general art of amusement devices and to the particular field of sporting equipment.

BACKGROUND OF THE INVENTION

Nearly every coach, player, or teacher involved with the game of baseball understands the benefits of constant hitting and batting practice.

This batting practice often requires the use of a pitcher. However, many teams, especially little league teams, do not have enough pitchers to assign one or more pitchers to batting practice. A coach is often relegated to such duty. However, this prevents that coach from carrying out his other duties. Thus, many teams do not have the facilities to accommodate all the hitters with enough batting practice to fully satisfy their needs.

It is also noted that a batting practice pitcher is also subject to danger due to the numerous balls that will be hit back towards him. Thus, many teams have to purchase protective screens to protect the batting practice pitcher. This is an extra burden on many small teams.

Accordingly, the art has included several automatic pitching machines. However, these machines are often complex, expensive and difficult to operate, store, move and control. They are often so expensive as to be out of the reach of small teams such as little league teams.

Therefore, there is a need for an automatic pitching machine which is easy to operate, store, move and control, and can be used by any team, including a little league team or the like.

OBJECTS OF THE INVENTION

It is the main object of the present invention to provide an automatic pitching machine which is easy to operate, store, move and control.

It is another object of the present invention to provide an automatic pitching machine which is easy to operate, store, move and control, and can be used by any team, including a little league team or the like.

SUMMARY OF THE INVENTION

These, and other, objects are achieved by an automatic pitching machine that uses magnetic energy to accelerate the ball to a suitable pitching speed, and which includes a carriage for the ball which is shaped to deliver the ball in an effective manner.

BRIEF DESCRIPTION OF THE DRAWING FIGURES

DETAILED DESCRIPTION OF THE PREFERRED EMBODIMENT OF THE INVENTION

Figure 1:
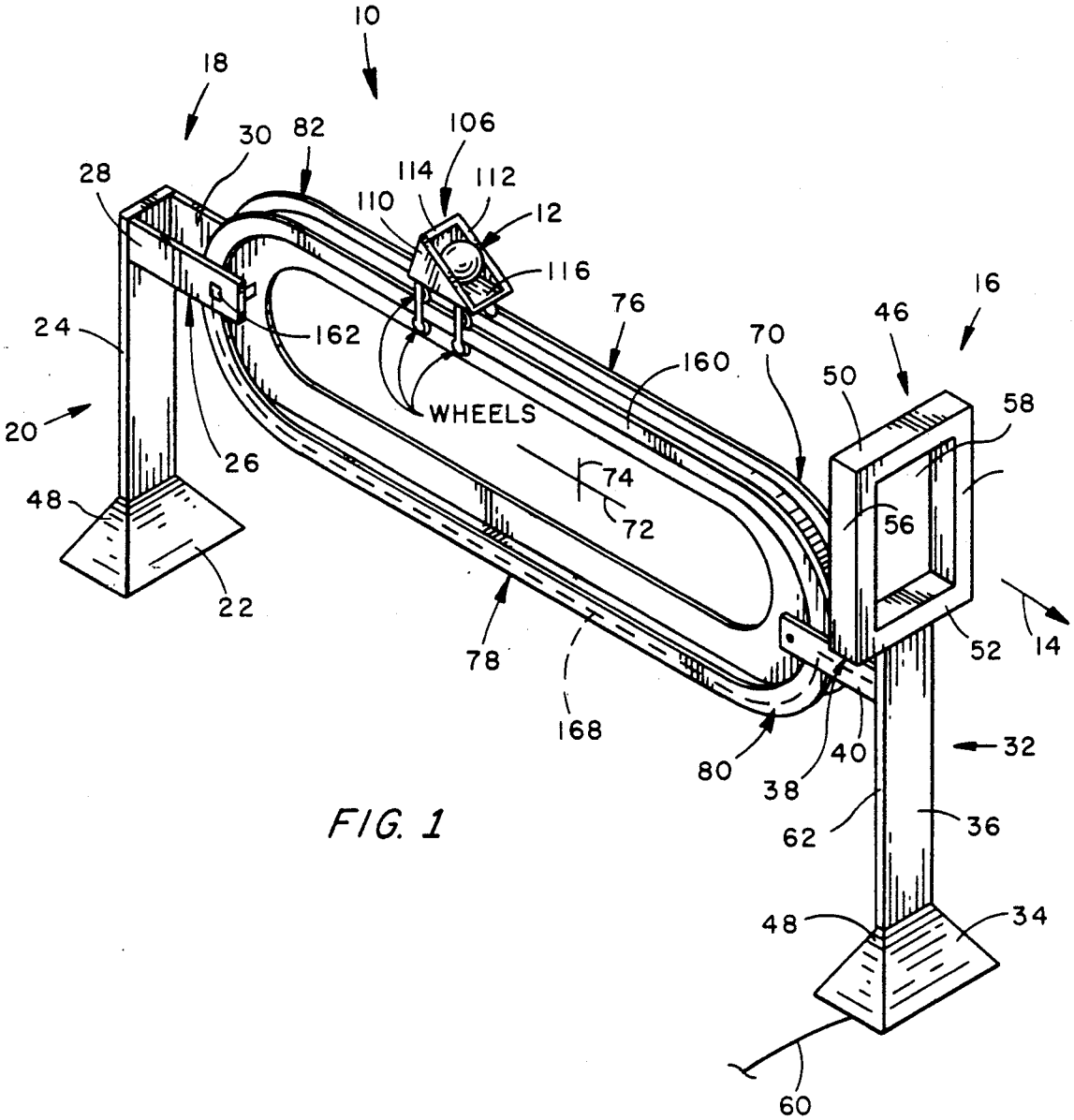
FIG. 1 is a perspective view of the pitching machine embodying the present invention.

Shown in FIG. 1 is a baseball pitching machine 10 embodying the present invention. The pitching machine

10 is used to throw a baseball 12 to a batter located in front of the machine in the direction indicated in FIG. 1 by the arrow 14. Accordingly, for the sake of this discussion, the machine 10 will be considered as having a forward end 16 and a rear end 18, and the terminology used herein will be used in reference to such directions.

The machine 10 includes a rear pedestal element 20 having a base 22 that rests on the ground and a standard 24 that extends upwardly from the base when that base rests on the ground as shown in FIG. 1. A rear connection link 26 extends forwardly of the rear standard 24 and includes two arms 28 and 30 that are spaced apart by the width of the standard 24.

Figure 3:
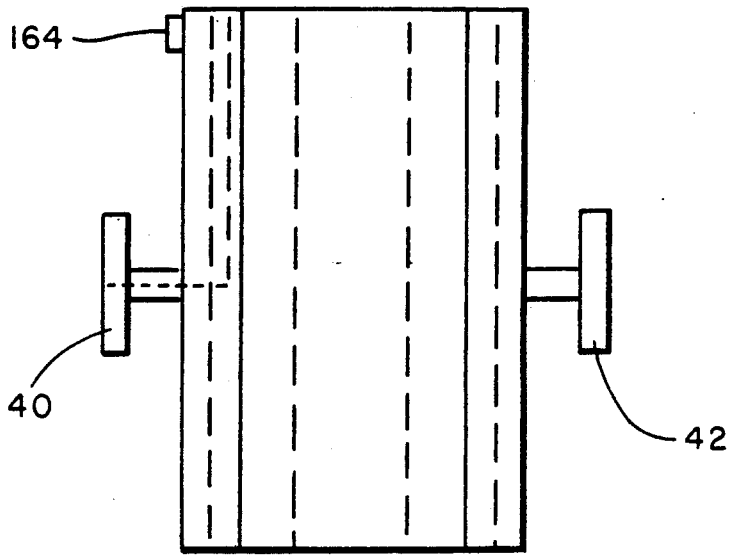
FIG. 3 is an end elevational view of the track of the pitching machine.

The machine 10 also includes a forward pedestal element 32 having a base 34 that rests on the ground and a standard 36 that extends upwardly from that base. A forward connection link 38 extends rearwardly of the forward standard and includes two arms 40 and 42 (see FIG. 3) that are spaced apart by the width of the standard 36.

A rectangular electromagnet structure 46 is mounted on top of the forward standard 36 at a height suitable for the pitching function of the device. Both of the standards are slidably received in the base associated therewith so the height of the various elements of the machine, such as the electromagnet, can be adjusted. Suitable fasteners, such as bolt 48 are used to secure the standard to the base once the suitable height is selected.

The electromagnet structure 46 includes a top end 50, a bottom end 52, a first side 54 and a second side 56 that are connected together to form the rectangular peripheral shape shown in FIG. 1 having an open area 58 defined within and by the perimeter thereof.

The electromagnet is designed according to the usual principals of such elements to include a coil surrounding a core as discussed in basic textbooks such as "University Physics" by Sears and Zemansky and published by Addison-Wesley in 1955 the disclosure of which is incorporated herein by reference, and the control of such devices is also discussed in basic texts, such as "Basic Circuit Theory with Digital Computations" by L. P. Huelsman and published by Prentice-Hall in 1972, the disclosure of which is incorporated herein by reference. Accordingly, no further discussion of the exact details of the electromagnet will be presented herein. The magnet is powered from a power source via a cord 60, and the magnetic force associated with the magnet is controlled by a knob 62 mounted on the standard and connected to the control circuit located in the base 34. The control circuit includes the usual circuit elements associated with control of such an element.

A track 70 is supported by the standards to be oriented in a vertical plane. The track has a peripheral shape of a prolate ellipse with a horizontally extending major axis 72 and a vertically extending minor axis 74. The prolate shape of the track produces a top section 76 and a bottom section 78 that are elongated in the direction of the major axis and which are connected by a forward return section 80 and a rear return section 82 that are arcuate in shape, with the top section being located in a higher elevated position than the bottom section.

Figure 2:
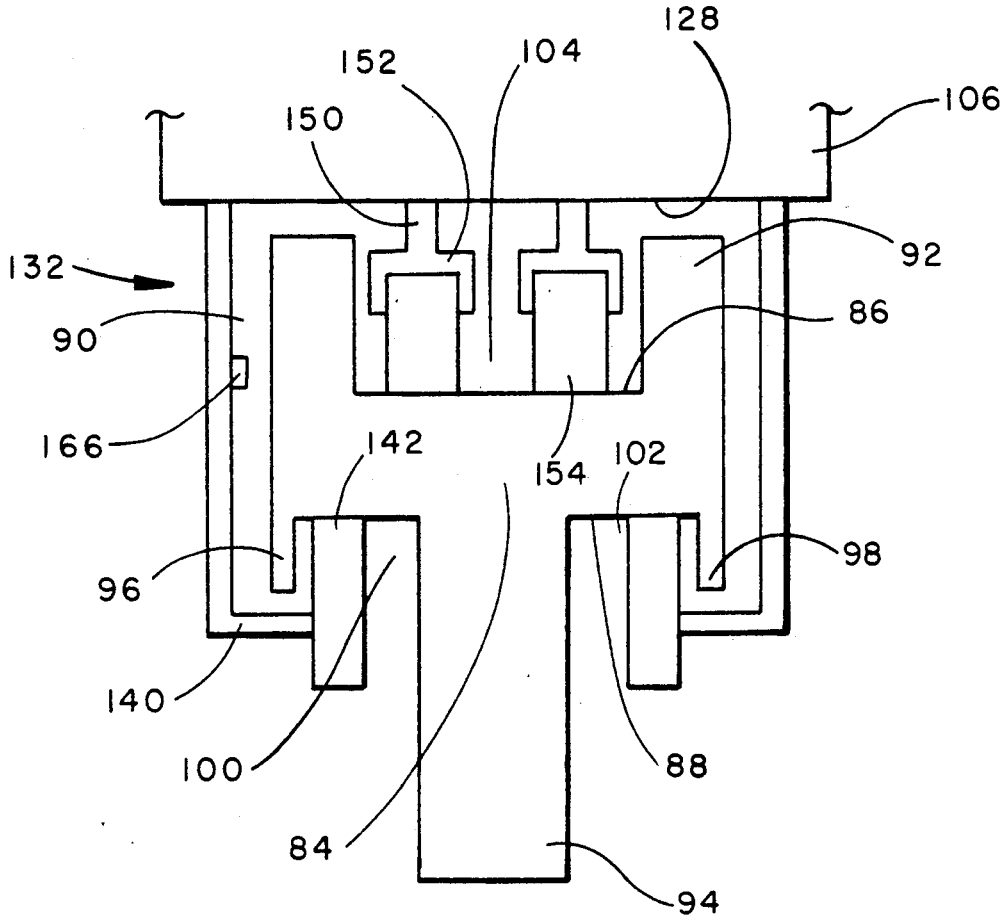
FIG. 2 is an elevational view of the track in conjunction with the bogie of a ball carriage element of the pitching machine.

The cross sectional shape of the track 70 is best shown in FIG. 2. The track is Y-shaped and includes a bight portion 84 having an inner surface 86 and an outer surface 88 and two side legs 90 and 92 that extend away from the inner surface 86 and a central leg 94 that extends away from the bight portion outer surface and is located centrally between the two legs 90 and 92. Two side flanges 96 and 98 extend from the bight portion outer surface to define outer tracks 100 and 102 between the central leg 94 and the flanges, with the side legs 90 and 92 defining with the bight portion inner surface 86 an upper track 104 between the side legs.

The top section 76 of the track is used to as an acceleration straightaway and the bottom section 78 of the track is used as a return straightaway on which a cart 106 is first accelerated and is then returned for another circuit. The baseball 12 is contained in the cart, and is thrown out of that cart as the cart passes around the forward return section 80 of the track as will be evident from the present discussion.

Figure 4:
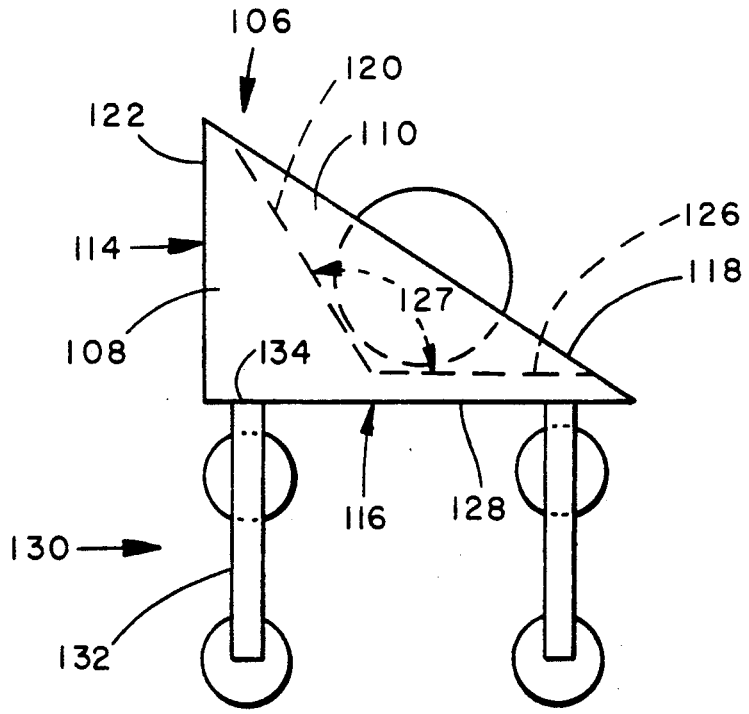
FIG. 4 is a side elevational view of the ball carriage of the pitching machine.

The cart 106 is best shown in FIGS. 1, 2 and 4, and includes a body 108 having the shape of a hollow right triangular pyramid into which the ball 12 is placed to be thrown by the machine. The cart is formed of material, such as metal, that will be strongly attracted to the electromagnet; whereas the track 70 is formed of plastics type material that does not interfere with operation of the electromagnet. The body 108 has two right triangular sides 110 and 112 that are parallel with each other and are connected by a rectangular rear wall 114 and a rectangular bottom wall 116. The rear wall 114 forms a first leg that is oriented to extend outward of the track, and the bottom wall forms a second leg that is oriented to extend in the direction of the track when the cart is moving on that track as shown in FIG. 1. The rear and bottom wall of each side are connected by a side edge 118 that forms an hypotenuse of the right triangle.

The cart has a sloping rear inner wall 120 that slopes away from the outer wall surface 122 towards the track as indicated in FIG. 4 to intersect a bottom wall inner surface 126 at an oblique angle 127. The bottom wall inner surface extends essentially parallel with the outer surface 128 of the bottom wall.

The cart 106 further includes a bogie assembly 130 that is best shown in FIGS. 2 and 4 to include four cart outer legs, such as outer leg 132 attached at an upper end 134 thereof to the cart bottom wall outer surface 128 and extending away from such surface toward the track 70. As is best shown in FIG. 2, the outer legs are connected to the cart to be spaced outwardly of the track side legs 90 and 92 when the cart is on the track so that they will not interfere with the movement of the cart on the track.

Each outer leg includes a first wheel supporting axle, such as axle 140 shown in FIG. 2 that is mounted on one end thereof to the leg and which extends toward the central leg 94 to have a second end thereof located between the side flange associated therewith and the central leg. A lower wheel 142 is rotatably mounted on each axle to rollably engage the track 102 and prevent the cart from flying off of the track due to centrifugal force as that cart moves around the track.

The cart also includes four inner legs, such as inner leg 150, attached at a top end thereof to the cart outer surface 128 and extending downwardly therefrom. The inner legs are located to be spaced from the outer legs and to be spaced inwardly from the track side legs 90 and 92 so as not to interfere with movement of the cart on the track. Each inner leg has an axle element, such as axle element 152, attached thereto and an upper wheel 154 is rotatably mounted on that axle. The upper wheels are located to rollably contact the upper track 104 and rotate thereover to support the cart on the track 70.

The movement of the cart is controlled by a control circuit that electrically connects the electromagnet to a source of power and which includes a first switch 160 mounted on the track 70 on the acceleration straightaway near the forward return section leading from the acceleration straightaway to the return straightaway, and a second switch 162 on the arm 28. The switches 160 and 162 are connected in series with each other and with the power source so that the second switch controls the first switch in a manner that will be discussed below. The first switch 160 includes an arm 164, and one of the outer legs of the cart includes a projection 166 that is located and sized to contact this arm 164. As the cart moves towards the electromagnet, it will pass the first switch, and the projection 166 will contact the arm 164 and throw the switch 160 from an "on" state to an "off" state. The switch 160 is re-set into the "on" state when the second switch 162 is operated. The switches 160 and 162 are connected with each other and with the control circuit in series by line conductors, such as line conductor 168, so that the switch 160 is automatically turned on when the switch 162, which can be a simple push button type switch, is actuated. The switch 160 is then turned off when the projection 166 on the cart contacts the arm 164 of that switch. The electromagnet 46 is connected to the power source via the switches 160 and 162 to be turned on when the switch 162 is activated, and to be turned off when the switch 160 is turned off. The cycle of operation of the electromagnet is thus controlled by initially activating the switch 162 so that the electromagnet is activated, and then the electromagnet is turned off when the switch 160 is turned off. The switch 162 is manually operated to begin the cycle over again. If the switch 162 is not depressed, the magnet will remain off, and the machine will, in essence, be turned off.

The strength of the electromagnet is controlled by the control knob 62, and the wheels are preferably made of low friction plastics type materials, such as TEFLON or the like so that friction does not unduly affect the operation of the machine.

The operation of the pitching machine is as follows. A baseball is placed in the cart and the switch 162 activated to activate the electromagnet. The electromagnetic force associated with the electromagnet 46 pulls the cart towards that electromagnet along the acceleration section of the track. As the cart is pulled along the track, it accelerates and as it passes the switch 160, the electromagnet is turned off. The momentum of the cart carries it forward and around the forward return section 80. As the cart rounds this curve, the ball is thrown out of the cart and passes through the electromagnet towards the batter in the direction 14. The sloping nature of the cart inner surface co-operates with the angles associated with the return section 80 so that the ball is thrown with the most effective force distribution as it leaves the cart. Thus, the oblique angle 127 formed between surfaces 120 and 126 of the cart is selected so that this co-operation is attained.

After the cart enters the return straightaway, it still has enough momentum to return to the rear return section 82, where the operator moves that cart into a starting position on the acceleration straightaway, places a new baseball in the cart, and actuates the switch 162 to begin the cycle over again. The machine 10 is so easy to operate, that a child can perform the necessary functions, and a coach or batting pitcher is not needed.

It is understood that while certain forms of the present invention have been illustrated and described herein, it is not to be limited to the specific forms or arrangements of parts described and shown.

I claim:

1. A baseball pitching machine comprising:

A) a rear pedestal standard having a rear connection link thereon;

B) a forward pedestal standard having a forward connection link thereon;

C) a rectangular electromagnet having a top end, a bottom end, a first side and a second side mounted on said forward pedestal standard, with said sides and ends defining a central opening through which a baseball passes;

E) a track having a peripheral shape of a prolate ellipse with a horizontally extending major axis and a vertically extending minor axis and being oriented in a vertical plane with respect to a ground surface, said track including (1) a Y-shaped cross-section having a bight portion which has an inner surface and an outer surface, two side legs extending from said bight portion inner surface, a central leg extending from said bight portion outer surface centrally between said side legs and in a direction opposite to said side legs, and two side flanges extending from said bight portion below said outer surface in the same direction as said central leg, (2) an acceleration straightaway, (3) a return straightaway, (4) a forward return portion, (5) a rear return portion, with said return portions connecting said straightaways together and said acceleration straightaway being positioned at a height greater than the height of said return straightaway;

F) a baseball carrying cart movably mounted on said track and including (1) a ball carrying body which includes an outer surface having the shape of a hollow right triangular pyramid with a first side oriented to extend perpendicularly and outwardly of said track, a second side oriented to extend parallel to the track and being connected at one end thereof to said first side thus forming a right angle with said first side, and a hypotenuse connected at one end thereof to said first side and at another end thereof to said second side, and an inner surface of said hollow right triangular pyramid with a bottom side extending parallel to said second side and a rear side which intersects said bottom side and extends at an oblique angle with respect to said bottom side, (2) four cart legs, each attached to said first side of said cart outer surface and extending away from said cart outer surface toward said track when said cart is on said track, each outer leg being located to be spaced from said track side legs when said cart is mounted on said track and including (a) a first wheel supporting axle mounted on a lower end of said each outer leg and extending from said lower end toward said track central leg and extending to a location between said track central leg and one of said side flanges, (b) a lower wheel rotatably mounted on said first wheel supporting axle and being sized to contact said track bight portion outer surface between said one side flange and said track central leg, (c) four cart inner legs, each to said first side of said cart outer surface and spaced from said cart outer legs so that all of said cart inner legs lie within a perimeter defined by said cart outer legs, and an upper wheel rotatably contacting said track bight portion inner surface; and G) a control circuit electrically connecting said electromagnet to a power source and including (1) a first switch mounted on said acceleration straightaway near said track forward return portion, (2) a second switch in electrical series with said first switch, (3) a first switch control arm mounted on said track and controlling said first switch, (4) a projection mounted on said cart in position to move said switch control arm from one position to another, and (5) electrical lead means connecting said switches to the power source and to said electromagnet.

2. The baseball pitching machine defined in claim 1 wherein all of said cart wheels are formed of low friction plastics type material.

3. The baseball pitching machine defined in claim 2 further including a control knob connected to said electromagnet to control the amount of pull exerted on said cart by said electromagnet.

4. The baseball pitching machine defined in claim 3 wherein said cart is formed of metal.

5. The baseball pitching machine defined in claim 4 wherein said track is formed of plastics type materials.

* * * * *